US007525075B1

(12) United States Patent
Watkins et al.

(10) Patent No.: US 7,525,075 B1
(45) Date of Patent: Apr. 28, 2009

(54) MICROWAVE SUSCEPTOR SYSTEM

(76) Inventors: Jeffrey T. Watkins, 1205 18th Ave. S., Princeton, MN (US) 55371; James P. Dohanick, 13745 231st Ave. NW., Elk River, MN (US) 55330

( * ) Notice: Subject to any disclaimer, the term of this patent is extended or adjusted under 35 U.S.C. 154(b) by 75 days.

(21) Appl. No.: 11/621,472

(22) Filed: Jan. 9, 2007

(51) Int. Cl.
*H05B 6/80* (2006.01)

(52) U.S. Cl. ..... 219/730; 219/725; 219/727; 219/729

(58) Field of Classification Search ..... 219/725–735, 219/759, 763; 99/DIG. 14; 426/94, 104, 426/234, 241–243; 428/34.2, 34.3, 35.2, 428/295.1
See application file for complete search history.

(56) References Cited

U.S. PATENT DOCUMENTS 4,705,929 A * 11/1987 Atkinson ..... 219/730
5,223,685 A * 6/1993 DeRienzo, Jr. ..... 219/732
5,260,070 A * 11/1993 Peleg ..... 426/94
5,688,427 A * 11/1997 Gallo, Jr. ..... 219/732
6,137,099 A * 10/2000 Hamblin ..... 219/730
6,627,862 B1 * 9/2003 Pedersen ..... 219/730

* cited by examiner

*Primary Examiner*—Tu B Hoang
*Assistant Examiner*—Vinod D Patel

(57) ABSTRACT

A microwave susceptor system for efficiently cooking food in a microwave. The microwave susceptor system includes a base positionable in a microwave, a first platform including a plurality of first openings, wherein the first platform is attached to the base and a second platform including a plurality of second openings, wherein the second platform is attached to an opposite end of the base. An outer surface of the base, first platform and second platform are comprised of a heat collecting material and a food item is positioned upon the first platform and the second platform.

1 Claim, 8 Drawing Sheets

MICROWAVE SUSCEPTOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to microwave platforms and more specifically it relates to a microwave susceptor system for efficiently cooking food in a microwave.

2. Description of the Related Art

Any discussion of the prior art throughout the specification should in no way be considered as an admission that such prior art is widely known or forms part of common general knowledge in the field.

Microwave platforms have been in use for years. Typically, microwaveable platforms are utilized by positioning a desired food item (i.e. sandwich, pizza, etc.) on top of the microwaveable platform and then cooking the food item in the microwave. The microwaveable platforms generally have a metallic or other heating material attached to an upper side of the platform which radiates heat toward the food item.

The microwavable platforms currently used generally do not provide a maximum heating source for food to be cooked upon. The platforms generally do utilize the heating material on all sides of the platform, wherein not utilizing an entire surface area with the heating material may increase microwaving time needed. Also, current microwave platforms generally do not provide a means for creating an aesthetically pleasing food item.

In these respects, the microwave susceptor system according to the present invention substantially departs from the conventional concepts and designs of the prior art, and in so doing provides an apparatus primarily developed for the purpose of efficiently cooling food in a microwave.

BRIEF SUMMARY OF THE INVENTION

In view of the foregoing disadvantages inherent in the known types of microwave platforms now present in the prior art, the present invention provides a new microwave susceptor system construction wherein the same can be utilized for efficiently cooking food in a microwave.

The general purpose of the present invention is to provide a new microwave susceptor system that has many of the advantages of the microwave platforms mentioned heretofore and many novel features that result in a new microwave susceptor system which is not anticipated, rendered obvious, suggested, or even implied by any of the prior art microwave platforms, either alone or in any combination thereof.

The invention relates to a microwave platform which includes a base positionable in a microwave, a first platform including a plurality of first openings, wherein the first platform is attached to the base and a second platform including a plurality of second openings, wherein the second platform is attached to an opposite end of the base. An outer surface of the base, first platform and second platform are comprised of a heat collecting material and a food item is positioned upon the first platform and the second platform.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a microwave susceptor system that will overcome the shortcomings of the prior art devices.

A second object is to provide a microwave susceptor system for efficiently cooking food in a microwave.

Another object is to provide a microwave susceptor system that includes multiple susceptor layers for increased heat generation.

An additional object is to provide a microwave susceptor system that includes multiple layers to add rigidity for easier handling.

A further object is to provide a microwave susceptor system that focuses an energy pattern for achieving grill lines.

Another object is to provide a microwave susceptor system that includes a film on all outer surfaces to improve moisture resistance.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
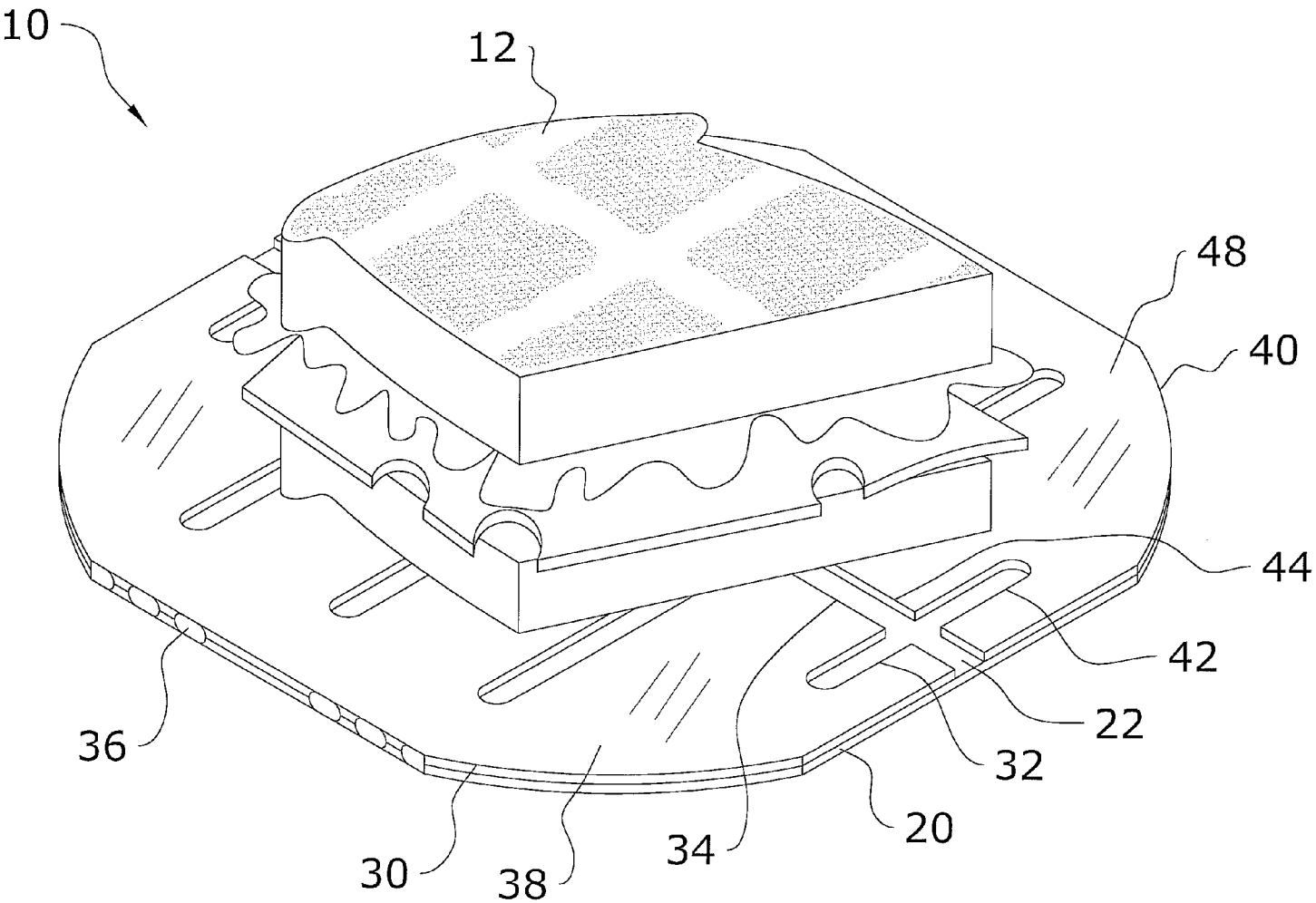
FIG. 1 is an upper perspective view of the present invention in use.

Turning now descriptively to the drawings, in which similar reference characters denote similar elements throughout the several views, FIGS. 1 through 8 illustrate a microwave susceptor system 10, which comprises a base 20 positionable in a microwave, a first platform 30 including a plurality of first openings 32, wherein the first platform 30 is attached to the base 20 and a second platform 40 including a plurality of second openings 42, wherein the second platform 40 is attached to an opposite end of the base 20. An outer surface of the base 20, first platform 30 and second platform 40 are comprised of a heat collecting material and a food item 12 is positioned upon the first platform 30 and the second platform 40.

B. Base

Figure 2:
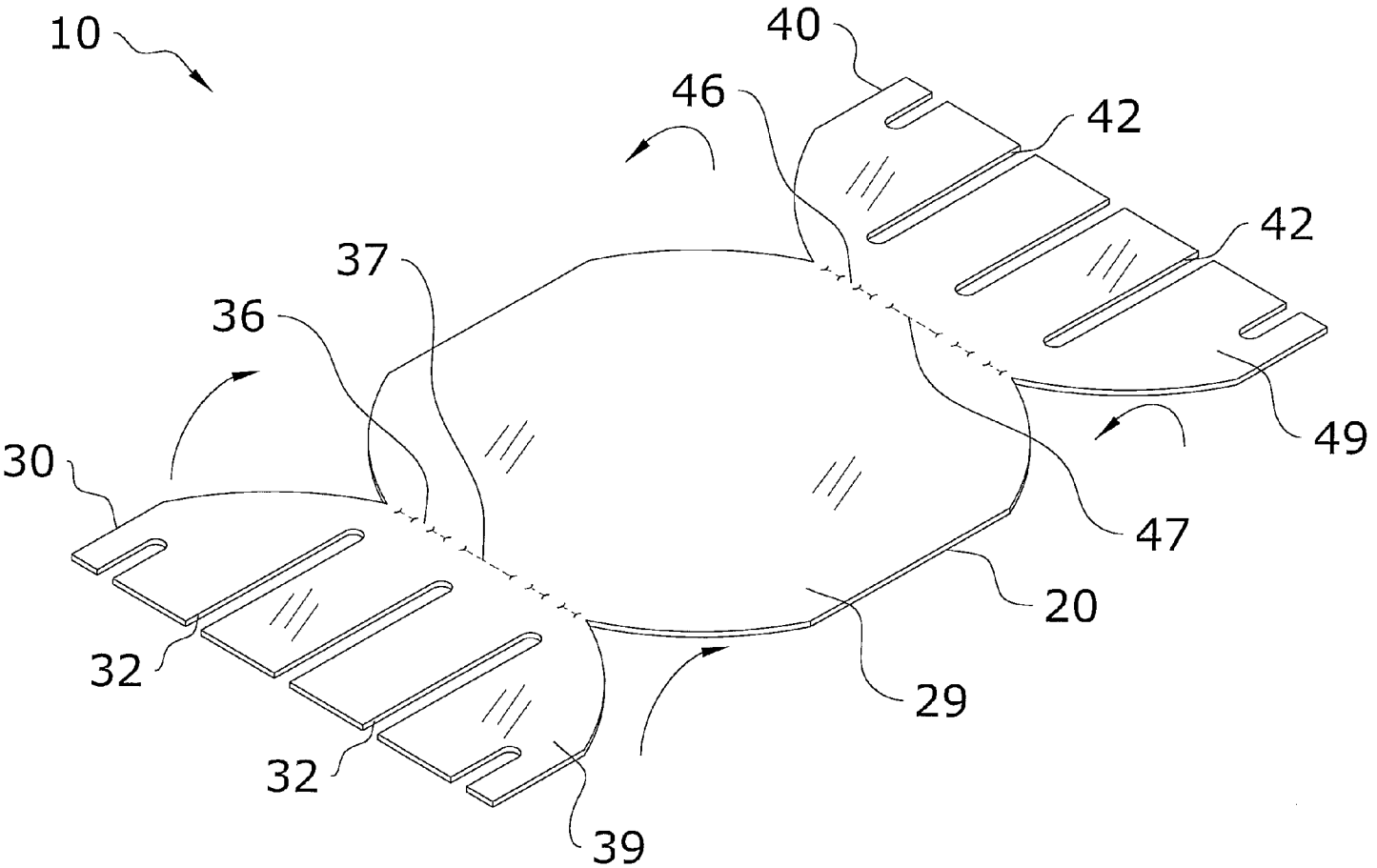
FIG. 2 is an upper perspective view of the present invention in a flat state and illustrating the folding patterns.
Figure 3:
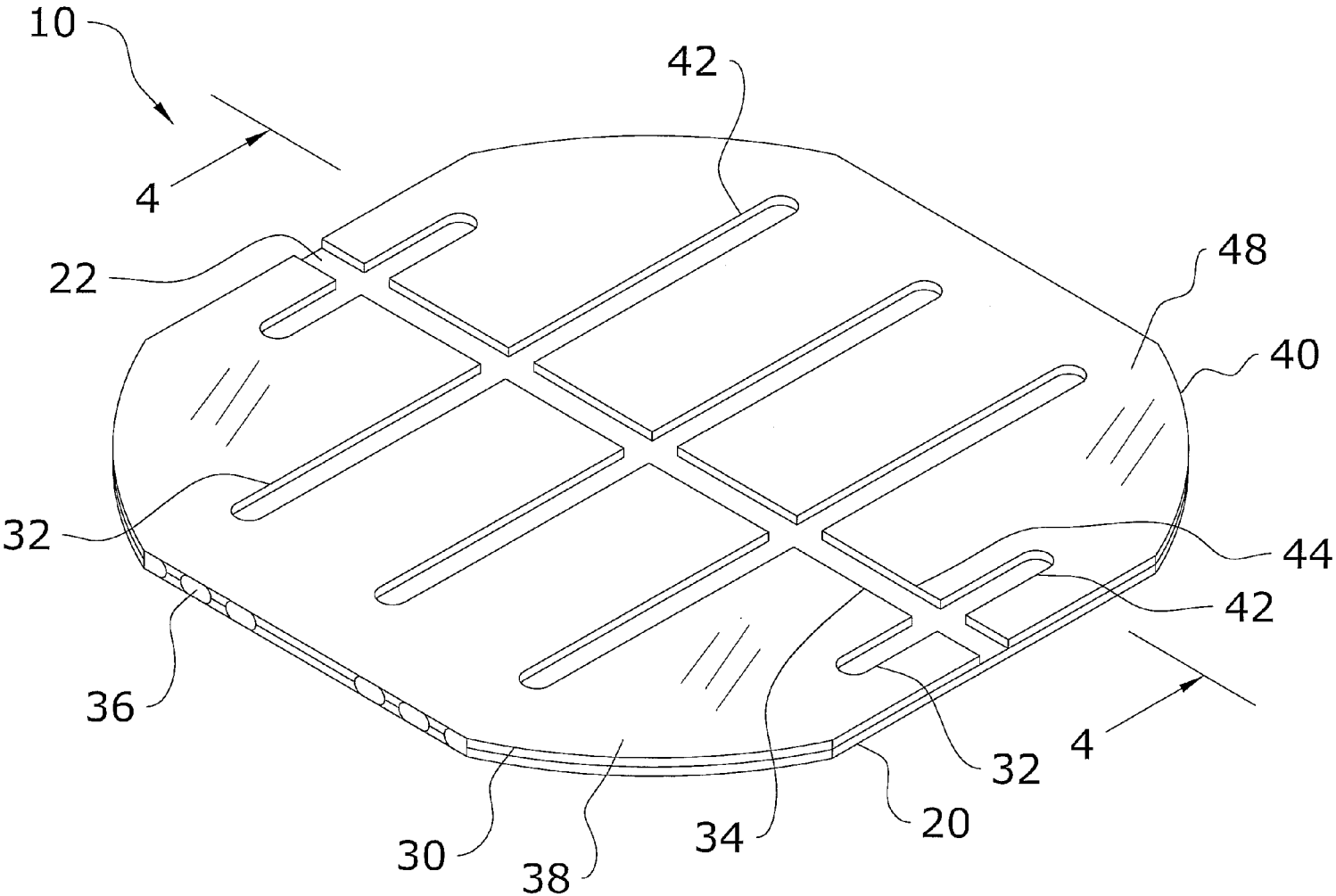
FIG. 3 is an upper perspective view of the present invention assembled.
Figure 4:
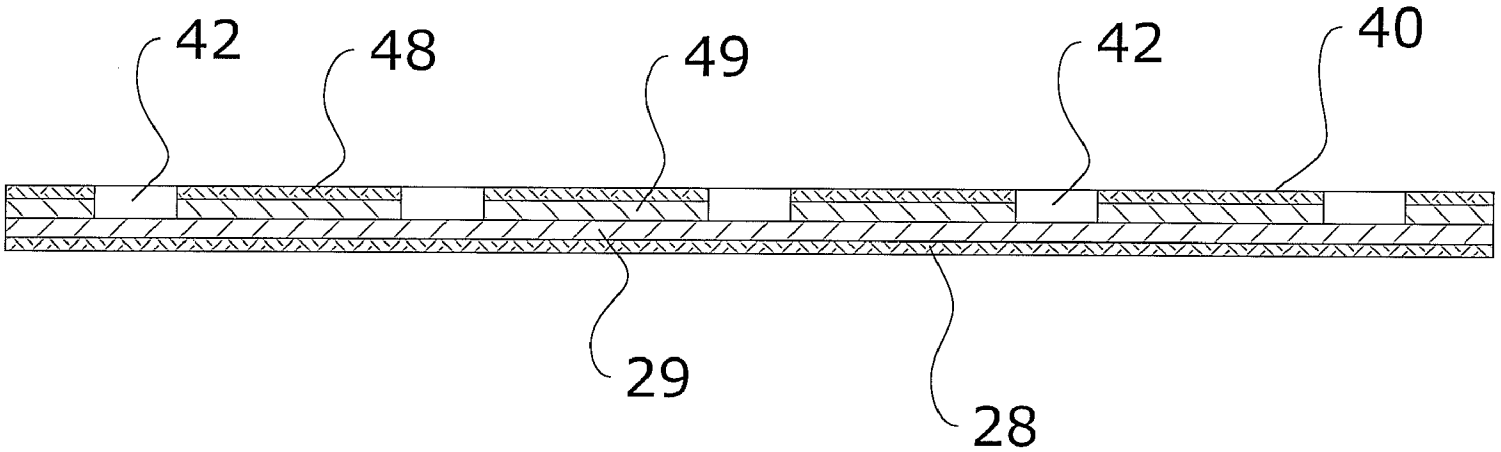
FIG. 4 is a sectional view taken along lines 4-4 of FIG. 3.

The base 20 rests on the bottom cooking surface of the microwave. The base 20 is preferably comprised of a substantially flat structure as shown in FIGS. 2 and 4 of the drawings. A first surface area of the base 20 is preferably smaller than a second surface area of the bottom cooking surface of the microwave to allow easy positioning of the base 20 within the microwave. The base 20 is preferably comprised of a hexagonal shaped configuration as shown in FIGS. 1 through 3. It is appreciated however that the base 20 may be comprised of various configurations and shapes rather than the preferred embodiment, such as but not limited to circular, rectangular or triangular.

The base 20 is comprised of a microwavable material. The base 20 is further preferably comprised of a lightweight material, such as but not limited to paperboard; however it is appreciated that various materials may be utilized with the base 20 rather than the preferred embodiment.

The base 20 includes a first outer surface 28 and a first inner surface 29. The first outer surface 28 of the base 20 is preferably lined with a heat collecting material. Further, the first outer surface 28 is preferably lined with a susceptor material. The first outer surface 28 is preferably positioned against the bottom cooking surface of the microwave when the base 20 is in use. The base 20 is preferably comprised of a solid structure that does not have an opening within. It is appreciated that the base 20 does not necessarily include the heat collecting material, such as but not limited to in the alternate configuration of the present invention.

C. Platform

The platform is preferably positioned on the first inner surface 29 of the base 20. The platform is preferably comprised of a substantially similar configuration and size as the base 20. It is appreciated however that the platform may be comprised of a different size than the base 20. It is also appreciated that the platform may be comprised of various configurations, such as but not limited to circular, square or triangular. The platform is further of sufficient size and shape to support a food item 12 to be cooked within the microwave (e.g. sandwich, pizza).

The platform preferably includes a first platform 30 and a second platform 40. The first platform 30 and the second platform 40 preferably mirror each other as shown in FIGS. 1 through 3. The first platform 30 is preferably pivotally attached to a first end of the base 20, wherein the first platform 30 and the base 20 preferably form a first axis 37 as shown in FIG. 2. The second platform 40 is preferably pivotally attached to a second end of the base 20, wherein the second platform 40 and the base 20 preferably form a second axis 47 as further shown in FIG. 2.

The first end of the base 20 also preferably opposes the second end of the base 20. The first axis 37 and the second axis 47 are preferably substantially parallel to one another. The first axis 37 formed between the first platform 30 and the base 20 preferably includes a plurality of first perforations 36 to allow easier folding of the first platform 30 upon the base 20. The second axis 47 formed between the second platform 40 and the base 20 also preferably includes a plurality of second perforations 46 to allow easier folding of the second platform 40 upon the base 20.

The first platform 30 is comprised of a microwavable material. The first platform 30 is further preferably comprised of a lightweight material, such as but not limited to paperboard; however it is appreciated that various materials may be utilized with the first platform 30 rather than the preferred embodiment.

The first platform 30 includes a second outer surface 38 and a second inner surface 39. The second outer surface 38 of the first platform 30 is preferably lined with a heat collecting material. Further, the second outer surface 38 is preferably lined with a susceptor material. The second inner surface 39 of the first platform 30 is preferably positioned against the first inner surface 29 of the base 20. The second outer surface 38 of the platform is preferably directed upwardly so as to receive the food item 12 that is desired to be cooked as illustrated in FIG. 1.

The first platform 30 preferably includes a plurality of first openings 32 as shown in FIGS. 1 through 3. The plurality of first openings 32 preferably extend inwardly from a first inner edge 34 of the first platform 30. The plurality of first openings 32 are preferably positioned perpendicular to the first axis 37 formed between the first platform 30 and the base 20 as shown in FIGS. 1 through 3.

The second platform 40 is also comprised of a microwavable material. The second platform 40 is further preferably comprised of a lightweight material, such as but not limited to paperboard; however it is appreciated that various materials may be utilized with the second platform 40 rather than the preferred embodiment.

The second platform 40 includes a third outer surface 48 and a third inner surface 49. The third outer surface 48 of the second platform 40 is preferably lined with a heat collecting material. Further, the third outer surface 48 is preferably lined with a susceptor material. The third inner surface 49 of the second platform 40 is preferably positioned against the first inner surface 29 of the base 20 as shown in FIG. 4. The third outer surface 48 of the platform is preferably directed upwardly so as to receive the food item 12 that is desired to be cooked as illustrated in FIG. 1.

The first outer surface 28, second outer surface 38 and third outer surface 48 preferably create two layers of heat collecting material as shown in FIG. 4. The two layers of heat collecting material preferably cook a food item 12 faster and more efficiently within a microwave than a single layer of heat collecting material. It is appreciated that the microwave susceptor system 10 may include more or less layers of heat collecting material than the preferred embodiment. In one example of varying layers of heat collecting material the first inner surface 29, second inner surface 39 and third inner surface 49 may be lined with the heat collecting material, thus creating four layers of heat collecting material to be utilized with the present invention.

Figure 5:
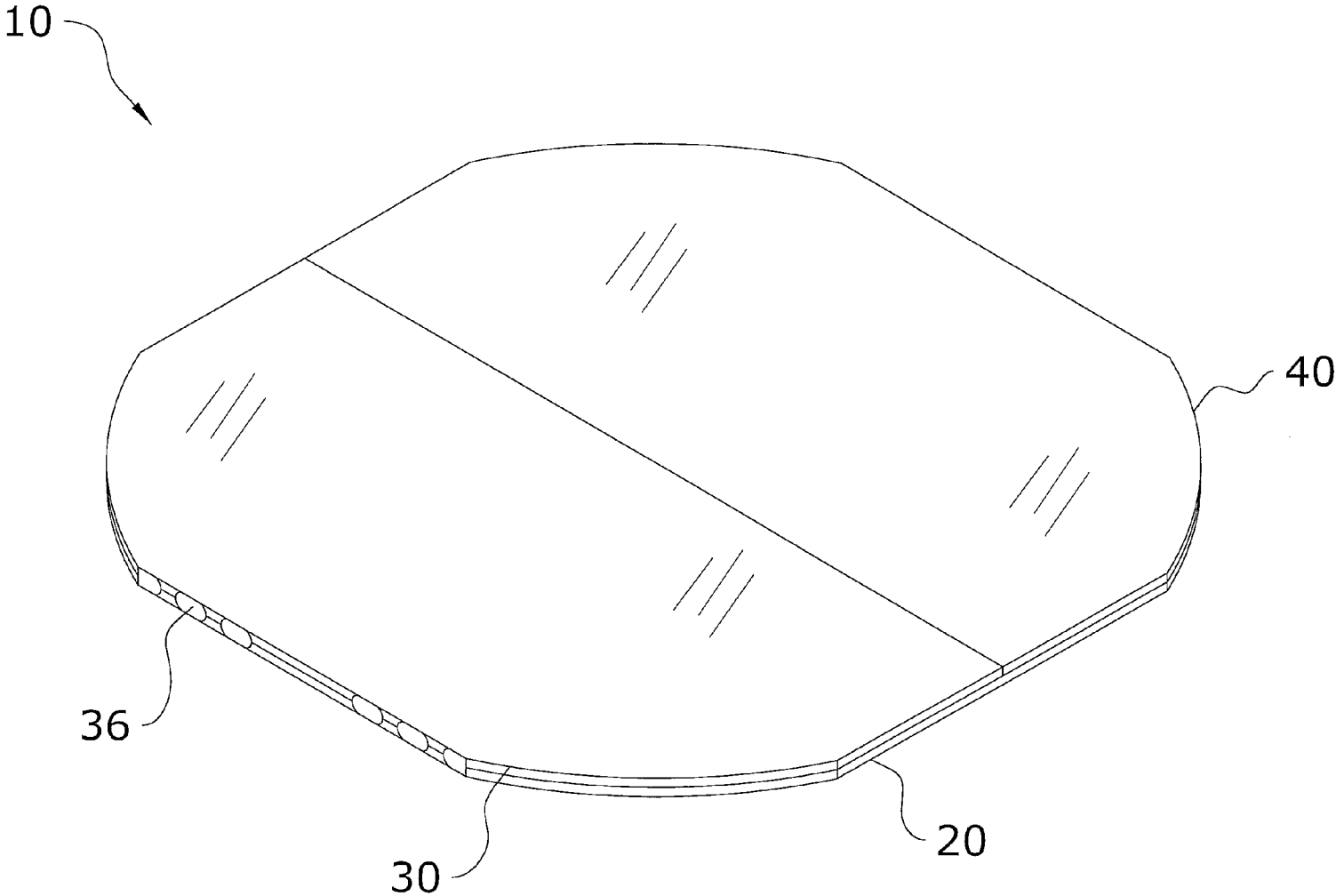
FIG. 5 is an upper perspective view of the present invention without the slots.

The second platform 40 preferably includes a plurality of second openings 42 as shown in FIGS. 1 through 3. The plurality second of openings preferably extend inwardly from a second inner edge 44 of the second platform 40. The plurality of second openings 42 are preferably positioned perpendicular to the second axis 47 formed between the second platform 40 and the base 20 as shown in FIGS. 1 through 3. It is appreciated the first openings 32 and the second openings 42 may be omitted from the first platform 30 and the second platform 40 if the grill lines are not desired upon the cooked food item 12 (i.e. pizza) as illustrated in FIG. 5.

A channel 22 is preferably formed in-between the first inner edge 34 and the second inner edge 44 as shown in FIG. 3. The channel 22 is preferably perpendicular to the first openings 32 and the second openings 42. The channel 22 preferably extends across an entire length of the first platform 30 and the second platform 40. The channel 22 also preferably fluidly connects the first openings 32 and the second openings 42. A first width of the channel 22 is also preferably substantially similar to a second width of the first openings 32 and a third width of the second openings 42.

The channel 22, along with the first plurality of openings and the second plurality of openings preferably allow moisture produced while cooking the food item 12 to escape the food item 12 and thus prevent the food item 12 from becoming soggy. The first plurality of openings, the second plurality of openings and the channel 22 also preferably create grilling patterns on the food item 12 while cooking the food item 12 in the microwave as illustrated in FIG. 1. The grilling patterns help to create a more aesthetically pleasing food item 12.

Figure 6:
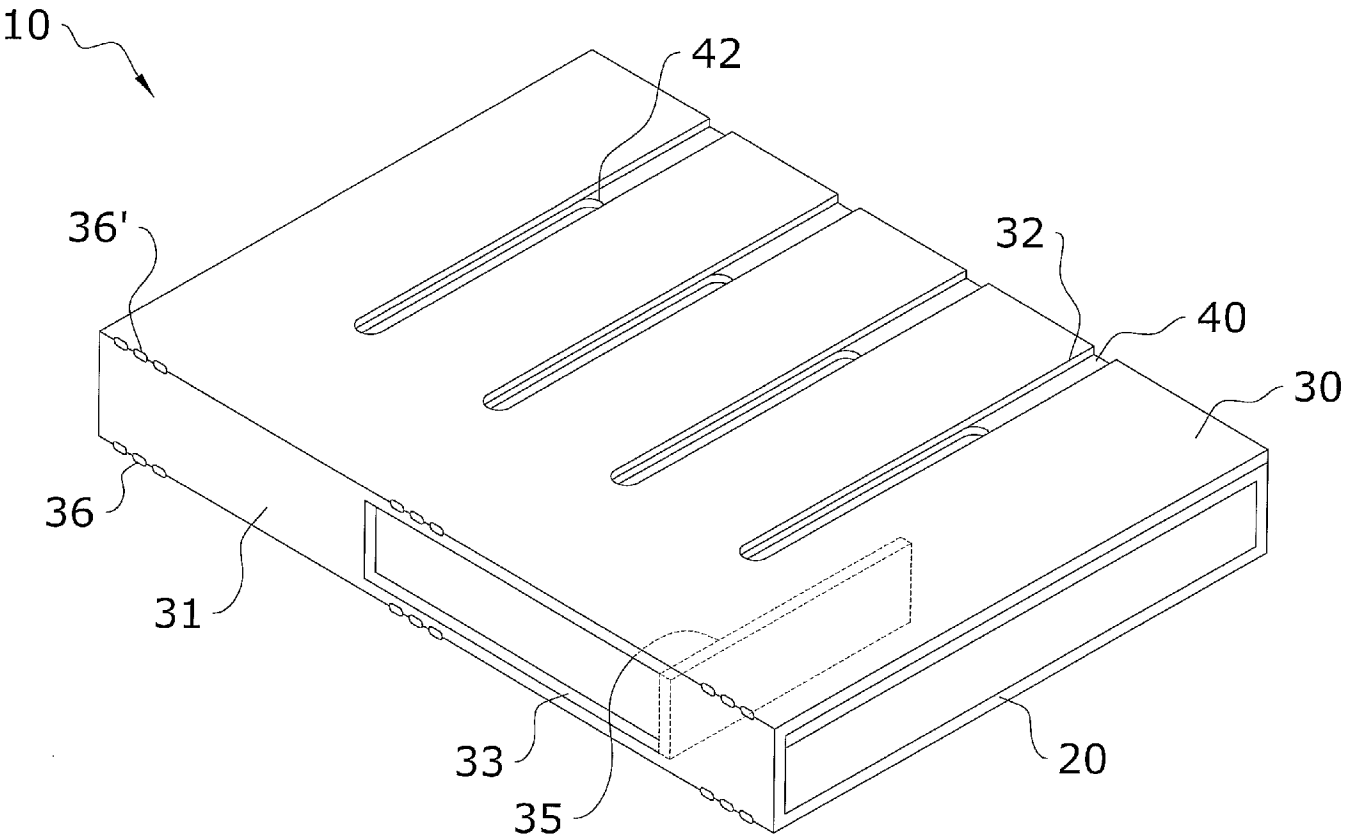
FIG. 6 is an upper perspective view of an alternate embodiment of the present invention.
Figure 8:
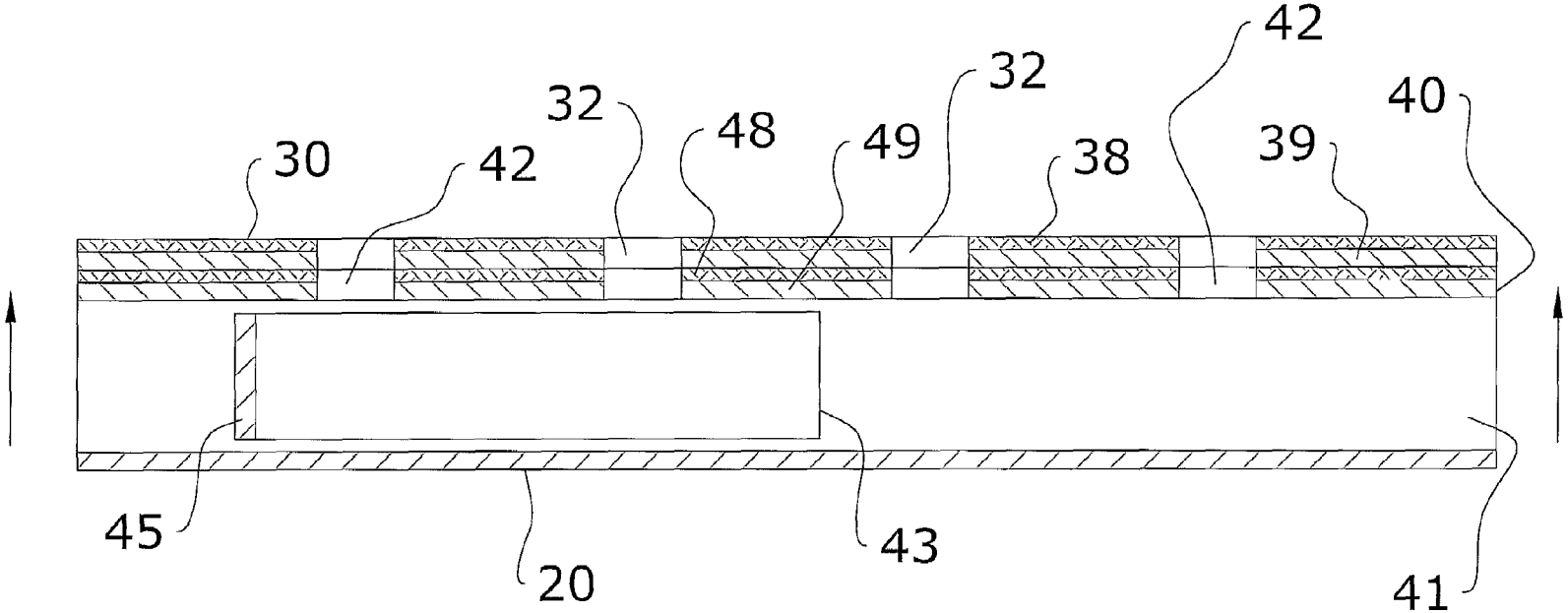
FIG. 8 is a cross-sectional view of the present invention in a second position.

In the alternate configuration of the present invention the first platform 30 and the second platform 40 are preferably elevated from the base 20 as illustrated in FIGS. 6 and 8. The elevation of the platforms 20, 30 provides insulation between the platforms 20, 30 and the floor of the microwave to better cook the food items 12. The first perforations 36, 36' of the first platform 30 and the second perforations 46, 46' of the second platform 40 form a first side wall 31 and a second side wall 41.

The first side wall 31 and the second side wall 41 also include a first support member 35 and a second support member 45. The first support member 35 pivots inward from the first side wall 31 between the platforms 30, 40 and the base 20 to support a first end of the platforms 30, 40. A first side opening 33 is also preferably formed within the first side wall 31 by the pivoting of the first support member 35. The second support member 45 preferably functions in a similar manner to the first support member 35, wherein the second support member 45 pivots inward from the second side wall 41 between the platforms 30, 40 and the base 20 to support a second end of the platforms 30, 40. A second side opening 43 is also preferably formed within the second side wall 41 by the pivoting of the second support member 45.

In the alternate configuration of the present invention the first platform 30 is preferably stacked upon the second platform 40. The first platform 30 also preferably includes the heat collecting material upon the second outer surface 38 and the second platform 40 also preferably includes the heat collecting material upon the third outer surface 48, wherein two layers of heat collecting material are formed. The first platform 30 and the second platform 40 also preferably include the first openings 32 and the second openings 42. The first openings 32 and the second openings 42 preferably overlap each other as shown in FIG. 6.

Figure 7:
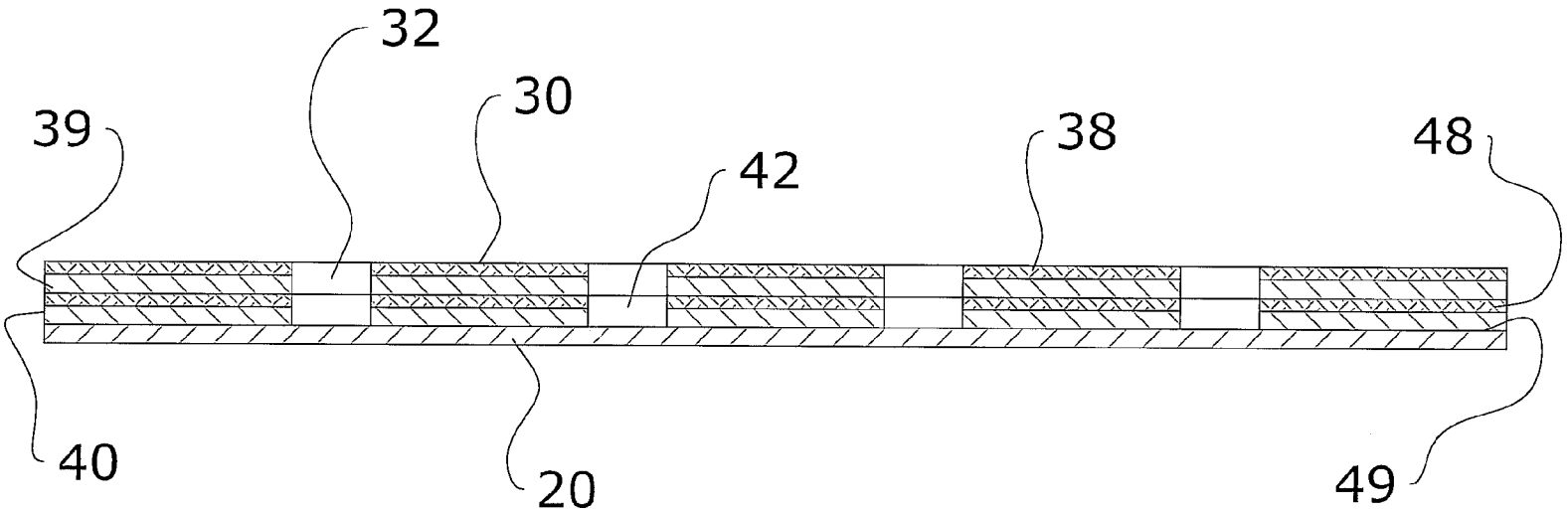
FIG. 7 is a cross-sectional view of the present invention in a first position.

In the alternate configuration of the present invention the first platform 30 and the second platform 40 also preferably pivot downward via the first perforations 36, 36' and the second perforations 46, 46'. When pivoting the first platform 30 and the second platform 40 downward the first support member 35 and the second support member 45 are ensured to be pivoted outward and parallel with the first side wall 31 and the second side wall 41. The first platform 30 and the second platform 40 are preferably pivoted downward as shown in FIG. 7 when not in use, such as but not limited to during storage.

D. Assembly of Invention

The microwave susceptor system 10 is preferably comprised of a single piece of paperboard as shown in FIG. 2. The single piece of paperboard is preferably simply cutout from a larger sheet of paperboard. The perforations and openings may be added after or during the cutting process. The paperboard is further preferably coated or laminated partially or fully on one side with a susceptor material.

An adhesive or other fastening material is applied to the second inner surface 39 of the first platform 30. The first platform 30 is then preferably folded inwardly along the first axis 37 and adjacent to a first half of the first inner surface 29 of the base 20 as illustrated with the arrows in FIG. 2. The adhesive or other fastening material is then applied to the third inner surface 49 of the second platform 40. The second platform 40 is then preferably folded inwardly along the second axis 47 and adjacent to a second half of the first inner surface 29 of the base 20 as illustrated with the arrows in FIG. 2.

In the alternate configuration of the present invention the second platform 40 is pivoted upwards and folded along the second perforations 46, 46', thus forming a second side wall 41. The second platform 40 is preferably folded so that the second platform 40 is parallel with the base 20 and the second side wall 41 is perpendicular to the base 20. The first platform 30 is then preferably folded in a similar manner as the second platform 40. The second inner surface 39 of the first platform 30 is then affixed to the third outer surface 48 of the second platform 40. The first support member 35 and the second support member 45 are now preferably pivoted inwards and substantially perpendicular to the side walls 31, 41.

E. In Use

In use, the microwave susceptor material is positioned upon the bottom cooking surface of the microwave. The food item 12 (i.e. sandwich, pizza) is then place upon the second outer surface 38 and the third outer surface 48 of the first platform 30 and the second platform 40. The food item 12 is also preferably substantially centered upon the first platform 30 and the second platform 40.

The microwave is then turned on, thus heating and crisping the food item 12. The food item 12 may be turned over halfway through the cooking process if grill patterns are desired on both sides of the food item 12. When the cooking is complete, the food item 12 is removed from the platform and the microwave susceptor system 10 is either washed and stored for later use or the microwave susceptor system 10 is discarded.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A microwave susceptor system, comprising:

a base having a first outer surface and a first inner surface, wherein said base is comprised of a substantially flat structure and wherein said first outer surface faces downwardly and is positioned adjacent a bottom cooking surface within a microwave;

wherein said base does not include an opening;

a platform having a second outer surface and a second inner surface, wherein said second outer surface faces upwardly and supports a food item to be heated;

wherein said base and said platform have a substantially mirror one another in size and shape;

wherein said platform is positioned adjacent to and attached to said base forming a substantially flat structure;

wherein said first inner surface of said base faces downwardly towards said second inner surface of said platform;

a first heat collecting material attached to said first outer surface of said base;

a second heat collecting material attached to said second outer surface of said platform, wherein said first heat collecting material and said second heat collecting material are comprised of a susceptor material; and at least one opening extending into said platform exposing said second inner surface of said base.

* * * * *